US005664711A

United States Patent [19]

Mellon

[11] Patent Number: 5,664,711

[45] Date of Patent: Sep. 9, 1997

[54] BOTTLE HOLDING DEVICE

[76] Inventor: Edward T. Mellon, 2125 Merlin Pl., El Cajon, Calif. 92019

[21] Appl. No.: 327,190

[22] Filed: Oct. 21, 1994

[51] Int. Cl.[6] ..... A45D 19/00; A41D 19/00

[52] U.S. Cl. ..... 224/217; 224/249; 224/251; 224/247; 224/148.4; 224/148.7; 132/73

[58] Field of Search ..... 224/217, 218, 224/219, 222, 267, 249, 251, 148, 247; 132/73, 73.5; 401/6, 7, 8; 215/395

[56] References Cited

U.S. PATENT DOCUMENTS

| | | | |
|---|---|---|---|
| 1,094,888 | 4/1914 | Ehrle | 401/8 |
| 2,140,231 | 12/1938 | Jefferis | 224/217 |
| 2,356,722 | 8/1944 | Harris | 224/217 |
| 2,865,384 | 12/1958 | Noon | 132/73 |
| 3,402,984 | 9/1968 | Zazzara | 401/8 |
| 3,938,769 | 2/1976 | Wetherbee | 248/312 |
| 3,964,709 | 6/1976 | LaBelle et al. | 248/133 |
| 4,148,424 | 4/1979 | Fortenberry | 224/218 |
| 4,312,465 | 1/1982 | Sinkhorn et al. | 224/36 |
| 4,373,632 | 2/1983 | VanZandt | 206/457 |
| 4,606,484 | 8/1986 | Winter et al. | 224/218 |
| 4,646,953 | 3/1987 | Marshall et al. | 224/217 |
| 4,955,572 | 9/1990 | Simmons | 248/312 |
| 5,141,188 | 8/1992 | DeBlasi et al. | 248/142 |
| 5,238,161 | 8/1993 | Kimishima | 224/217 |

*Primary Examiner*—Linda J. Sholl

[57] ABSTRACT

A bottle holding device has a clamp for gripping a bottle or other container and defining a gripping axis, and a finger gripping arm projecting from the clamp in a direction transverse to the gripping axis. The gripping arm extends at least partially around at least one of the user's fingers to hold the bottle adjacent the user's fingers in a readily accessible and stable position.

6 Claims, 2 Drawing Sheets

BOTTLE HOLDING DEVICE

BACKGROUND OF THE INVENTION

The present invention relates generally to bottle holding devices and devices for holding other types of containers, and is particularly concerned with a device for holding a bottle of cosmetics such as nail polish while the polish or other cosmetic material is applied.

Nail polish is typically applied by a brush which is attached to the bottle cap and which is coated with nail polish, brushed onto one or more fingernails, and then dipped again into the bottle to re-coat with polish for application to additional fingernails. When a person applies polish to their own fingernails, it is difficult and cumbersome to repeatedly dip the brush into the bottle, which may be standing at some distance away from the hand being polished, and at the same time avoid smudging of wet polish on fingernails to which polish has already been applied and possible spilling of polish onto the hands or adjacent surfaces. It is normally necessary to tilt the bottle in order to insert the brush more easily and to allow it to be coated with polish, further adding to the difficulty of the operation. It is also relatively difficult to hold the fingers in a steady position during polish application.

SUMMARY OF THE INVENTION

It is an object of the present invention to provide a new and improved bottle or container holding device for nail polish bottles and the like.

According to the present invention, a bottle holding device is provided for holding a bottle or container adjacent a person's hand at all times while the bottle contents are being applied, for example while nail polish is applied to the fingernails. The device comprises a clamp for gripping a bottle, the clamp defining a bottle gripping axis with which the central axis of the bottle is aligned when gripped by the clamp, and a finger gripping portion projecting transversely from the clamp, the finger gripping portion being adapted to at least partially encircle at least one of the user's fingers so as to hold the bottle adjacent the fingers.

In one embodiment of the invention, the clamp comprises a flat end portion having an opening for fitting over the neck of a bottle, the central axis of the opening comprising the bottle gripping axis, and the finger gripping portion comprises an arm projecting to one side of the flat end portion, the arm having an inner end adjacent the flat end portion, an outer end, and a U-shaped portion between the inner and outer end for seating a selected finger of the user with the inner and outer ends extending over the adjacent fingers. Preferably, the outer end is a flat platform which is co-planar with the flat clamping end portion for balance and stability.

With this arrangement, the user can seat one finger, normally the middle finger, in the U-shaped portion of the gripping arm so that the inner end of the arm projects over the top of the first finger and the outer end projects over the top of the third finger, with the clamp projecting to one side of the first finger. Thus, a bottle held in the clamp will be positioned adjacent the user's fingers while the fingernails are polished, and can be tilted as needed simply by tilting the hand. When the fingernails of the other hand are to be polished, the user simply removes the device from the first hand, reverses it and mounts it in the same way on the fingers of the other hand. This will make finger polishing much easier and more convenient, and will reduce the risk of spills. The finger gripping arm will also help to keep the fingernails steady and aligned during polishing.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
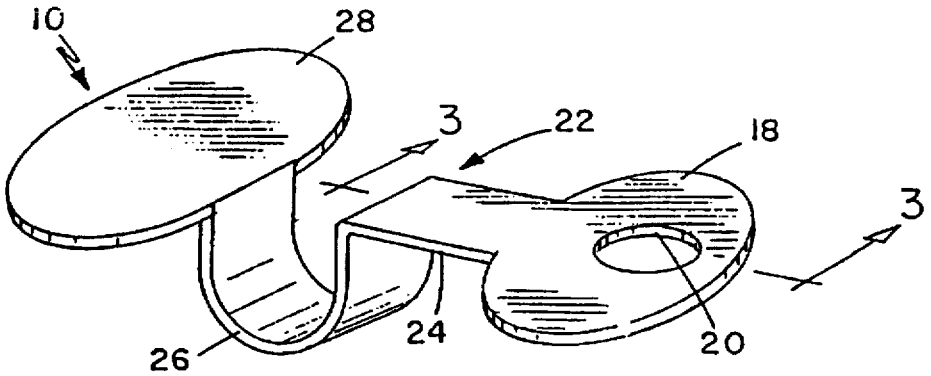
FIG. 1 is a perspective view of the bottle holding device according to a first embodiment of the invention.
Figure 2:
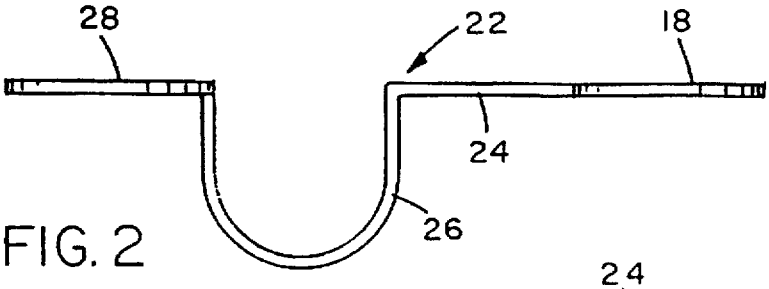
FIG. 2 is a side elevation view of the device.
Figure 3:
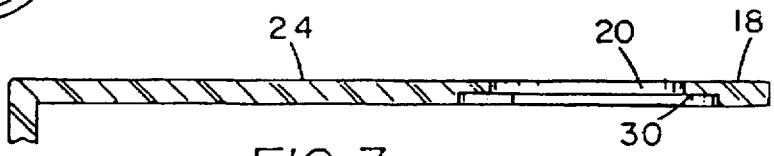
FIG. 3 is a section on the lines 3—3 of FIG. 1.
Figure 4:
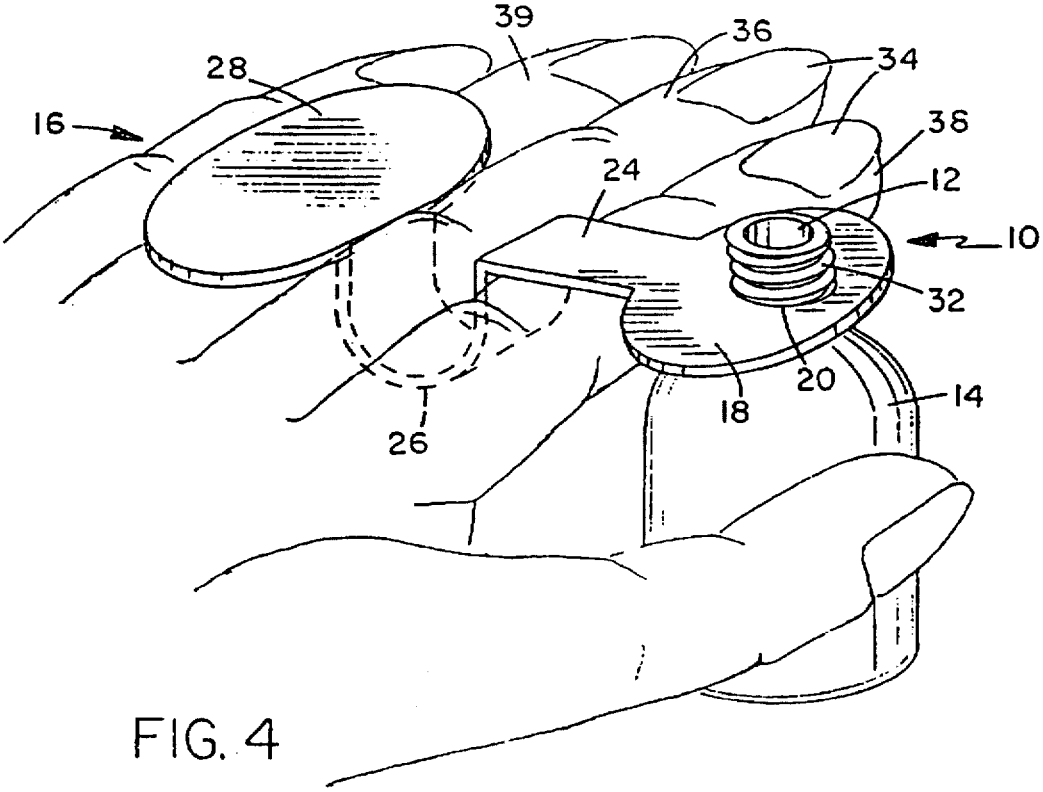
FIG. 4 illustrates the device in use.

FIGS. 1–3 of the drawings illustrate a bottle holding device 10 according to a first embodiment of the invention which is particularly intended to hold the neck 12 of a nail varnish bottle 14 adjacent the user's hand 16 as illustrated in FIG. 4. Although in the preferred embodiment of the invention the device is designed to hold a nail varnish bottle, it will be understood that it may alternatively be adapted to hold any bottle or container adjacent a user's hand while the products in the bottle or container are applied or used, for example other types of cosmetic containers or bottles.

The bottle holding device 10 has a generally oval-shaped flat end portion 18 having an opening 20 forming a clamp for gripping the neck 12 of bottle 14. A finger gripping arm or handle 22 projects transversely from portion 18. Arm 22 has an inner flat portion 24, a downwardly depending U-shaped portion or finger seat 26, and an outer, oval-shaped flat platform 28. Portion 24 and platform 28 are co-planar with clamping end portion 18. The entire device 10 may be molded integrally from a single piece of plastic which may be suitably cut to the desired flat shape and then heated to allow U-shaped bend portion 26 to be formed. Alternatively, arm 22 may be a flat piece of flexible plastic with a metal insert strip. The arm may then be bent as desired to conform to the shape of the user's finger or fingers.

Preferably, the end portion 18 has a reduced thickness annular ring portion or Web 30 surrounding opening 20. The diameter of opening 20 will be substantially equal to the outer diameter of neck 12 and will be of smaller diameter than that of the screw threads 32. Web 30 will have sufficient flexibility to allow the opening 20 to be forced over the screw threads 32 on neck 12 so that the device holds the bottle as illustrated in FIG. 4. The central axis of opening 20 will define the gripping or orientation axis of the bottle gripped by device 10.

Nail polish or varnish bottles typically have a cap for threaded engagement over neck 30, with a brush secured to the inner face of the cap and projecting into the contents of the bottle when the bottle is not in use. When a user wishes to apply varnish to their fingernails 34, they simply remove the cap of the bottle, and force the opening 20 to snap onto the neck 30. The user then positions one of their fingers, typically middle finger 36, into the U-shaped seat 26 so that portion 24 projects over the top of first finger 38 and platform 28 rests on top of third finger 39. The bottle will then be held securely adjacent the user's fingers, which simultaneously grip the gripping arm 22 and are also held by arm 22 in a straight, aligned position as illustrated in FIG. 4.

Once the user has positioned the bottle as illustrated in FIG. 4, they can use their other hand easily to dip the brush into the polish and apply polish to the fingernails, which will tend to be held ready in the position illustrated by the action of the gripping arm. The device 10 may be positioned farther back to allow the fingertips to be slightly spread apart, if desired. U-shaped seat 26 and flat platform portions 24 and 28 will tend to hold the fingers straight and parallel to one another, making it easier to apply polish evenly. The user can easily tilt the bottle 14 without risk of spilling its contents, simply by tilting the hand 16, simultaneously tilting the holding device 10 by the same amount. Once the nails of the first hand have all been varnished, the fingers are withdrawn from the gripping arm, and the device is reversed to be gripped in a similar manner by the fingers of the other hand. The first hand is then used to apply varnish to the nails of the other hand. This device will reduce the risk of smudging varnish while it is applied or when it is not yet dry, and will make application of nail varnish a significantly easier task.

Figure 5:
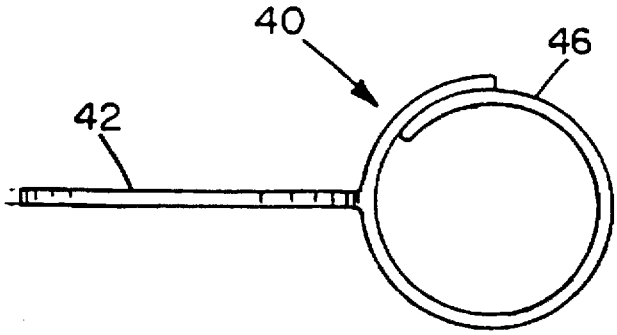
FIG. 5 is a side elevation view of a bottle holding device according to a second embodiment of the invention.
Figure 6:
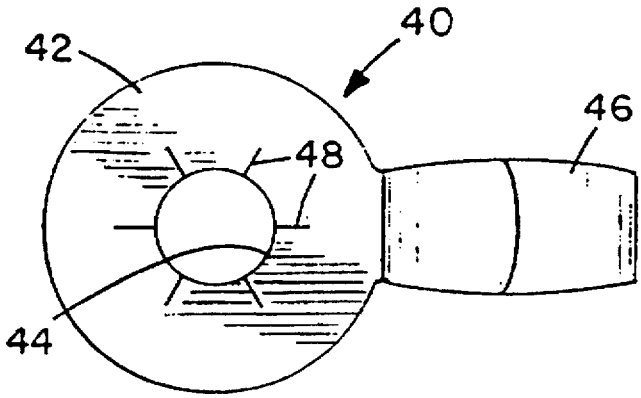
FIG. 6 is a top plan view of the device of FIG. 5.

The device may be left permanently in place on the neck of the bottle 14, simply screwing down the cap over portion 18 when the varnish is not in use. In other alternative embodiments, other types of finger gripping arms or devices may be used to secure the clamping device adjacent the user's fingers. FIGS. 5 and 6 illustrate a bottle holding device 40 according to another embodiment of the invention. In this embodiment, a first, flat end portion 42 has an opening 44 for gripping engagement over the neck of a bottle. The finger gripping portion comprises a simple loop 46 for extending around the user's index finger. Loop 46 is oriented perpendicular to flat portion 42. A series of radial slits 48 is provided around the periphery of opening 44 for allowing the opening 44 to snap onto a bottleneck. Slits 48 may also be provided around opening 20 of the first embodiment, if desired.

Alternative clamping or fastener devices may be used to attach the device to the bottle instead of opening 20, for example a snap-on C-clamp arrangement or other types of snap fastener. The bottle or bottleneck may be modified for snap engagement with a clamping device, if desired. The holding device may be permanently secured to the bottle.

Figure 7:
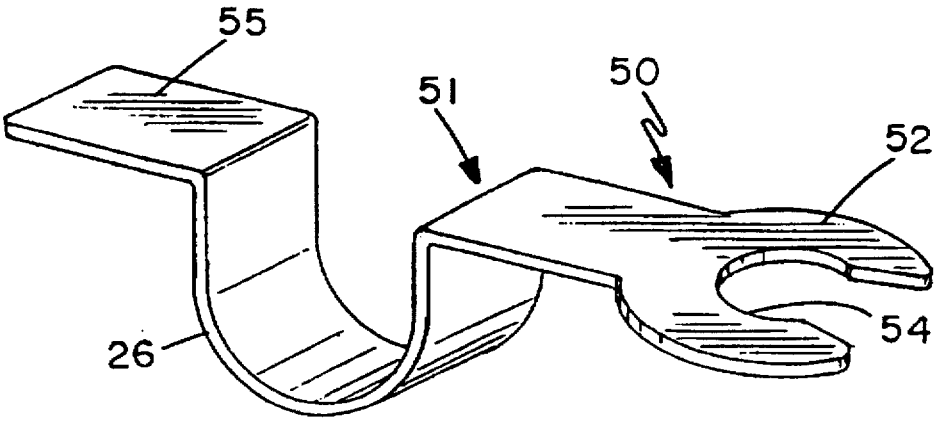
FIG. 7 is a perspective view of a device having a modified bottle gripping portion.

FIG. 7 illustrates an alternative embodiment in which bottle holding device 50 has a finger gripping arm 51 similar to that of the first embodiment, and a modified bottle gripping portion 52 comprising a C-clamp 54 for snapping around the neck of a bottle. Finger gripping arm 51 is identical to arm 22 of the first embodiment except for the end portion 55 which is not enlarged. However, end portion 55 may be enlarged if desired to provide a surface for applying a logo or the like.

The handle arm may be separate from the bottle gripping portion in alternative embodiments, with a snap fastener mechanism for releasably securing the parts together.

The bottle holding device of this invention allows a user to hold a bottle of nail varnish or the like adjacent the fingers without needing to use their other hand to hold or tilt the bottle, leaving the other hand free to apply varnish. At the same time, the finger gripping arm 22 provides stability and helps to orient the fingers in an appropriate orientation for easy application of varnish.

Although a preferred embodiment of the invention has been described above by way of example only, it will be understood by those skilled in the field that modifications may be made to the disclosed embodiment without departing from the scope of the invention, which is defined by the appended claims.

I claim:

1. A bottle holding device, comprising:

a clamp for gripping a bottle, the clamp defining a bottle gripping axis;

a finger gripping arm projecting to one side of the clamp in a direction transverse to the bottle gripping axis, the finger gripping arm being adapted to at least partially encircle at least one of the user's fingers so as to hold a bottle gripped by the clamp adjacent the user's fingers;

said clamp comprising a flat member having an opening for clamping engagement around the neck of a bottle;

the finger gripping arm being formed integrally with said flat member; and the finger gripping arm comprising a first flat portion co-planar with said flat member, and a U-shaped portion extending outwardly from said flat portion to form a seat for one of the user's fingers with the first flat portion extending over the top of a finger adjacent the seated finger.

2. The device as claimed in claim 1, wherein the finger gripping arm has inner and outer ends on opposite sides of said U-shaped portion for extending over the top of fingers adjacent said selected finger.

3. The device as claimed in claim 2, wherein said inner and outer ends are flat.

4. The device as claimed in claim 3, wherein said outer end is an enlarged flat platform for seating over a finger.

5. The device as claimed in claim 1, wherein the finger gripping arm further comprises an outer flat portion coplanar with said first flat portion and of larger surface area than said first flat portion.

6. The device as claimed in claim 1, wherein the clamp comprises a C-clamp for snap engagement around a bottleneck.

* * * * *